United States Patent [19]

Watts

[11] Patent Number: 4,493,120

[45] Date of Patent: Jan. 15, 1985

[54] PLAYPEN

[76] Inventor: David Watts, 1326 Madison Ave., New York, N.Y. 10028

[21] Appl. No.: 434,767

[22] Filed: Oct. 18, 1982

[51] Int. Cl.[3] ..... A47C 29/00

[52] U.S. Cl. ..... 5/99 B; 252/25

[58] Field of Search ..... 256/25; 5/99 C, 99 B, 5/98 R, 99 R, 98 A

[56] References Cited

U.S. PATENT DOCUMENTS

| | | | |
|---|---|---|---|
| 3,351,323 | 11/1967 | Spencer | 256/25 |
| 3,430,273 | 3/1969 | Stillwaugh | 5/99 R |
| 4,376,318 | 3/1983 | Cirillo | 5/99 C |

FOREIGN PATENT DOCUMENTS

| | | | |
|---|---|---|---|
| 1430850 | 1/1966 | France | 256/25 |

*Primary Examiner*—Andrew V. Kundrat

*Attorney, Agent, or Firm*—Nolte, Nolte and Hunter

[57] ABSTRACT

A portable and collapsible playpen has two side walls supported under tension by a pair of poles bent in the form of an arch and crossing each other like an "X" midway of their length. The poles are divided into segments for ease of assembling and segments of each pole nest together inside a hub at both front and back ends of the pen.

8 Claims, 4 Drawing Figures

PLAYPEN

BACKGROUND OF THE INVENTION (I) Field of the Invention

The present invention relates to a new and improved article of manufacture in the nature of a portable and collapsible enclosure for infants or young children: in short, what is colloquially termed a "playpen".

Depending upon the age and size of the person to be accommodated therein, the product of the invention might also be termed a "play-yard", that is, a framed enclosure made for the purpose of containing (without unduly restraining) a child until the child attains a height in the order of about thirty-four inches (864 mm) or a weight of about 30 pounds (13.6 kg) more or less.

An important object of the invention is to provide thereby a readily collapsible and portable means for maintaining the child safely within a predetermined limited space, such as to be close to or adjacent the child's parent or other person responsible for the child's safety. The present playpen is also suitable for back-packing, and for use on the beach, or while traveling. With a conventional "tie-down" the playpen may be placed on a bed and, thus, used as a crib. It can be easily stored in a relatively small space, and readily packed for travelling.

(II) Description of the Prior Art

U.S. Pat. No. 3,206,773 to Sarasin and U.S. Pat. No. 3,339,213 to Spencer disclose foldable playpens for infants' use which are generally rectangular in shape. The Cone U.S. Pat. No. 4,186,454 is illustrative of a portable playpen having a generally hexagonal contour.

In the patent to Moss, U.S. Pat. No. 4,236,543, a portable tent is the subject. This tent includes a flexible covering having two substantially similar side walls. In addition two resiliently flexible poles are held flexed by such side walls so that the side walls are thereby held under tension or tense thereby shaping and supporting the tent. In this way the tent is rendered stable or free-standing. The article further includes a flared top portion which is closed by netting or similar material so as to permit ventilation of the tent and to permit viewing of the outside topography by anyone occupying the tent.

BRIEF SUMMARY OF THE INVENTION

According to this invention there is proposed a free-standing, collapsible and portable enclosure, preferably for the use of infants, and comprising a web-like flexible floor and two side walls with inter-fitting front and back walls. The two side walls are constructed and arranged so as to be held in free-standing position by a pair of coacting resiliently flexible elongated tubes, to which the peripheral edges of both side walls are attached so as to spread out the side walls and hold them under tension in a fixed position. Preferably the tubes may be broken up into relatively short sections adapted to be assembled in interfitting relationship with respect to each other. When so assembled, the two tubes are placed in opposition to each other so that when bent in substantially in the form of the letter "U", the ends of which may be put on the ground, they form a rectangle; with the bottoms of the "U's" (or centers of the parabolic arches) forming the topmost parts of the playyard or playpen.

Within the arms of the two bent tubes an enclosure of nylon mesh is supported under physical tension, itself adding to the structural strength by use of a sleeve running across the top of the parabolic arch of each of the two elongated tubes. As will be understood each tube passes through tunnels in the peripheral edges of the nylon mesh. Moreover, with the use of four tangential triangles on the two alternate ends of the playpen with a special hub at its center point on the two sides of the playpen, the arrangement is completed.

Stated in other terms, the present invention proposes a playpen for infants or children comprising two opposed side walls held under tension by means of flexed tubes (after the manner of U.S. Pat. No. 4,236,543—supra) but differing therefrom in that the tubes do not cross each other but are divided into a plurality of segments of substantially equal length which meet in the form of an "X" medially of the height of the playpen and at both the front and back walls of the article. Each of the two tubes is preferably divided into three segments or pieces of the same width and are connected together by means of a central hub or collar at both the front and rear of the playpen. This hub is generally circular and is provided with four substantially identical apertures for receiving and releasably securing the adjacent ends of the four segments of the tubes terminating on either end of the playpen.

By reason of the relative positions of the tube segments which come together inside the collar or hub at each end of the pen, an open top or space of the playpen is constituted. That area is large enough to allow entrance and exit to and from the playpen by the child or infant for whose safety it is designed. It is defined by the parabolic structure of the two tubes on either side wall of the article, and the contour of the front and back walls. Taken together these four walls may be characterized as having a flexed parabolic arch on either side wall and a quadra-partite cross assembly of segments releaseably fixed in a central collar or hub. When so disposed each set of the four tubular segments which meet at the hub positioned in the front and back walls form, at that place, four substantially identical acute angles.

To render the playpen portable, the tubular segments of the four walls may be readily withdrawn from their respective sheet-like coverings which are then folded or rolled up for subsequent re-assembly elsewhere, or stored.

DESCRIPTION OF THE DRAWINGS

With the above and other objects in view, as will be apparent, the invention consists in the construction, combination and arrangement of parts, all as hereinafter more fully described, claimed and illustrated in the accompanying drawings, wherein:

Referring now more particularly to the drawings: FIG. 1 is a perspective view of a preferred embodiment of the invention which comprises a generally rectangularly shaped playpen 10 for children including a web-like flexible floor or bottom such as nylon the two opposing side walls 12 and 14, each formed of a web-like fabric such as nylon mesh and attached at their ends to the front and back walls 16, 18 similarly covered.

Figure 1:
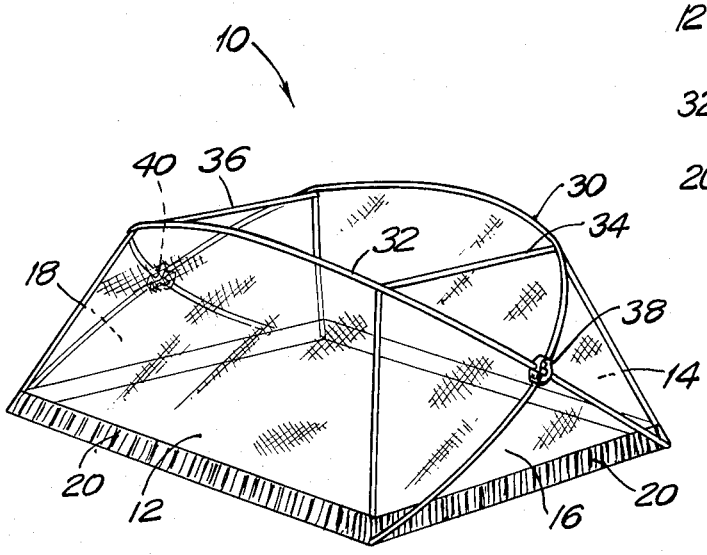
FIG. 1 is a perspective view of a playpen constructed and arranged according to the present invention and illustrating the flexed parabolic arches of the tubing which hold the tensioned sidewalls of the article, and the four triangles of each of the front and back walls including the central hub member.
Figure 2:
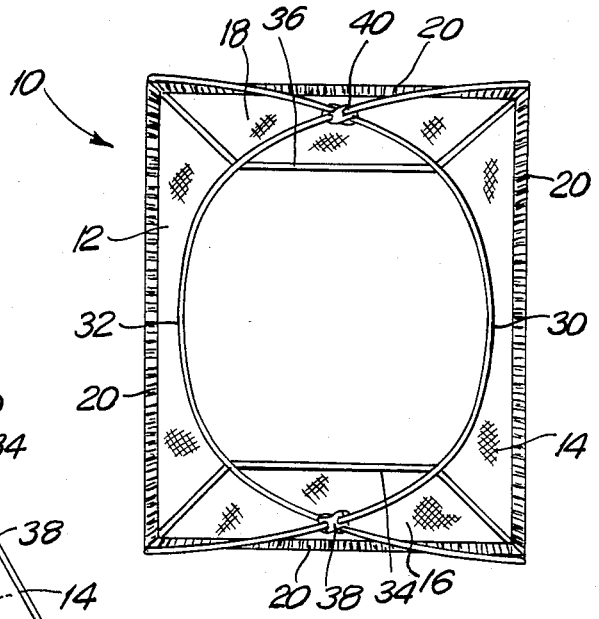
FIG. 2 is a plan view of the same.

Preferably the lower wedges of the four walls 12, 14, 16 and 18 are provided with a border or hem reinforcement 20 running completely around the base or built-in nylon bottom of the pen 10.

To keep the playpen erect in a free-standing position, two resiliently flexible tube members 30 and 32, preferably made in connectable sections for ease of assembly and disassembly, are inserted in through passages or tunnels provided in the four walls 12, 14, 16 and 18 of the pen 10. This arrangement is such that (as seen in FIG. 1) the tubes 30 and 32 cross each other in the form of an "X" at the front and rear of the playpen.

Two horizontally disposed tube sections 34, 36 may be similarly passed through free passageways in the top edges or portions of the front and back walls 16, 18 respectively.

As further noted in FIG. 1, the place where the flexed tubes 30 and 32 meet at the front end 16 of the pen 10 is at a hub or collar member 38. In like manner the rear portions of the tubes 30 and 32 meet at the back end of the tent 10 at the rear hub or collar 40.

As will be understood, if desired, the tubes 30, 32 may be pre-bent during their course of manufacture, so as to facilitate their subsequent employment with a parabolic arch-like contour. It is also to be noted that due to the junction of the tubes 30, 32 medially of the front and back walls 16, 18 of the present playpen 10, an opening at the top of the pen it is hereby defined by the upper portions of the four walls 12, 14, 16 and 18 which, in fact, is large enough to permit easy entry and deposit and removal of the infant or child (not shown) to be safeguarded therein.

Figure 3:
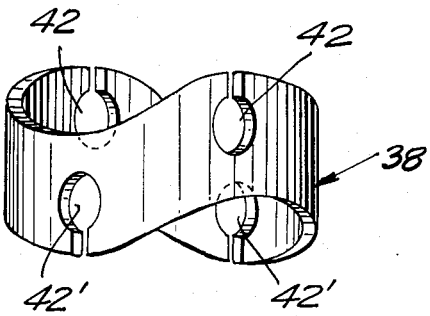
FIG. 3 is a perspective view of the central collar or hub member which is apertured to receive the four adjacent ends of the tube segments of the side walls.
Figure 4:
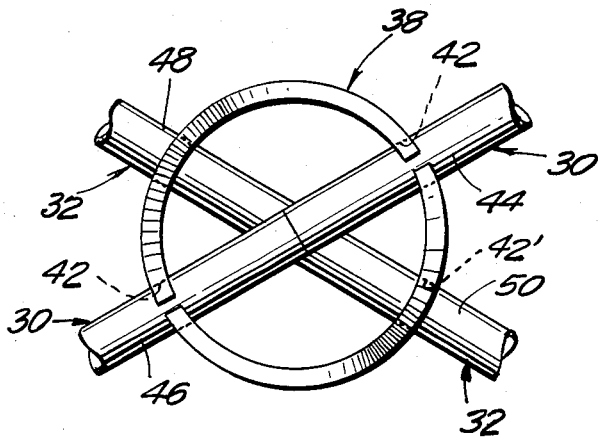
FIG. 4 is a schematic partial end view of the four coacting tube segments forming four acute angles of substantially equal size, and includes a schematic representation of the apertured control or central collar or hub within which the four tube segments meet.

Hub means for receiving and releasably hold the four segmented portions of the two side wall tubes 30 and 32 are illustrated in FIG. 3. Such may comprise a closed collar 38, preferably made of molded plastic material, and provided with two spaced upper openings 42 constructed and arranged to receive and releasably retain the interfitting terminal segments 44 and 46 of the tube 30. In like manner, the hub 38 is provided with two spaced lower apertures 42' similarly constructed and arranged to receive and releasably retail the interfitting end portions 48, 50 of the associated tube member 32.

Thus, the structure of the present invention as described above, provides a framed enclosure constructed and arranged for containing the child during a period while it is relatively small, as for example, until it attains a height of about 34 inches and a weight not substantially in excess of 30 pounds. The playpen, which may also be termed a "play-yard" is approximately 40 inches wide, 50 inches long and 24 inches high and may be made lightweight weighing in the order of about four pounds so as to render it readily portable and collapsible into a small nylon or cotton bag which bag itself may have a size no larger than 25 inches long by about 6 inches in diameter.

Moreover, as previously pointed out herein, the present play-yard or playpen is portable and may be readily moved after disassembling the same, from one portion of a house to another so as to enable a child to be kept in safety and close to or adjacent the parent or other person charged with its care. It is also light in weight: light enough to be lifted up and carried with one finger. To protect the child within it, the pen top and sides may be covered over with mosquito netting, with the top portion being releasably fastened to the remaining body by means, for example, of a "VELCRO" fastener. The playpen is also adapted to be used for "backpacking", on the beach, or in travelling. With a suitable "tie-down" this article of manufacture can be placed on a bed and used as a crib instead of as a playpen. It is easily stored or packed for travel.

What is claimed is:

1. A portable and collapsible playpen or the like comprising a web-like flexible floor a pair of opposed side walls formed of web-like fabric held under tension by means of two segmented flexed poles, front and back walls secured to the ends of the side walls and held under tension by means of two horizontal cross members, said walls defining a substantially rectangular free standing enclosure, and hub means at either end of said enclosure for receiving and releasably retaining at least two segments of each of said poles.

2. The playpen of claim 1 further characterized in that said walls are of substantially uniform height.

3. The playpen of claim 1 further characterized in that the hub means are interposed substantially medially of the height of said walls.

4. The playpen of claim 3 further characterized in that said hub means is provided with a plurality of apertures for securing said segments of said flexed poles.

5. The playpen of claim 4 further characterized in that the segments of one of said poles overlie segments of the other pole.

6. The playpen of claim 5 further characterized in that segments of at least one pole are in contact with each other at the center of said hub.

7. The playpen of claim 1 further characterized in that said hub means includes a circular collar apertured on upper and lower levels to receive and releasably retain the segments of said poles.

8. The playpen of claim 7 further characterized in that said collar comprises means for maintaining said poles out of contact with each other.

* * * * *